US008916787B2

(12) United States Patent
Glasson

(10) Patent No.: US 8,916,787 B2
(45) Date of Patent: Dec. 23, 2014

(54) APPARATUS AND METHOD FOR A SWITCHING MECHANISM

(75) Inventor: Richard O. Glasson, Morris Plains, NJ (US)

(73) Assignee: Control Products, Inc., East Hanover, NJ (US)

( * ) Notice: Subject to any disclaimer, the term of this patent is extended or adjusted under 35 U.S.C. 154(b) by 402 days.

(21) Appl. No.: 13/412,057

(22) Filed: Mar. 5, 2012

(65) Prior Publication Data

US 2013/0228426 A1 Sep. 5, 2013

(51) Int. Cl.

| | |
|---|---|
| ***H01H 1/64*** | (2006.01) |
| ***H01H 1/66*** | (2006.01) |
| ***H01H 9/02*** | (2006.01) |
| ***H01H 9/06*** | (2006.01) |
| ***H01H 13/00*** | (2006.01) |
| ***H01H 19/04*** | (2006.01) |
| ***H01H 19/08*** | (2006.01) |
| ***H01H 21/00*** | (2006.01) |

(52) U.S. Cl.
USPC ..... 200/293

(58) Field of Classification Search
CPC ..... H01H 35/34; H01H 35/24; H01H 35/26; H01H 35/2635; H01H 35/2657
USPC ..... 200/293, 82 R, 83 R, 83 J, 82 B, 82 A, 200/83 Q, 83 S, 83 SA, 140, 512, 305
See application file for complete search history.

(56) References Cited

U.S. PATENT DOCUMENTS

| | | | | |
|---|---|---|---|---|
| 4,356,360 | A | 10/1982 | Volz | |
| 4,752,658 | A * | 6/1988 | Mack | 200/82 R |
| 5,567,023 | A | 10/1996 | Yoo | |
| 5,577,605 | A * | 11/1996 | Dilly et al. | 200/564 |
| 5,670,766 | A * | 9/1997 | Ellett | 200/83 J |
| 5,671,841 | A | 9/1997 | Glasson | |
| 5,822,173 | A * | 10/1998 | Dague et al. | 361/283.3 |
| 7,732,722 | B1 * | 6/2010 | Singh et al. | 200/82 R |
| 2009/0229964 | A1 * | 9/2009 | Hickman | 200/83 R |

FOREIGN PATENT DOCUMENTS

| | | |
|---|---|---|
| KR | 20-0159220 | 10/1999 |
| KR | 10-2008-0008081 | 1/2008 |

OTHER PUBLICATIONS

The International Search Report & Written Opinion by the Korean Intellectual Property Office, issued on Jun. 26, 2013, in the corresponding PCT Application No. PCT/US13/27726.

* cited by examiner

*Primary Examiner* — Renee Luebke
*Assistant Examiner* — Anthony R. Jimenez

(57) ABSTRACT

A switching mechanism includes a housing, an actuator retained within the housing, and an electrical switching apparatus. The actuator includes an actuation element retained by the housing, where at least a portion of the actuation element is positioned for receiving an actuation load, and a plunger substantially in contact with the actuation element and operable to translate when an actuation load is applied to the actuation element. A sealing element placed around a second cylindrical portion of the plunger contacts inner surfaces of the housing to provide a seal between a first end and second end of the housing. The actuator also includes a spring operable to apply a force to resist translation of the plunger. An electrical switching apparatus is retained by the second end of the housing.

19 Claims, 7 Drawing Sheets

APPARATUS AND METHOD FOR A SWITCHING MECHANISM

BACKGROUND

Switching mechanisms may be used in a wide variety of applications including, for example, measurement of vehicle engine operations, measurement of valve states (for example, open, closed or other states), and/or many other applications. Switching mechanisms may be subjected to high pressure, high temperature, and other environmental factors during operation. A switching mechanism resistant to variable pressure loads, high temperatures, and other conditions may, therefore, be desirable.

SUMMARY

Briefly, aspects of the present disclosure are directed to a switching mechanism and a method of manufacturing a switching mechanism. A switching mechanism may include a housing including a first end and a second end. The first end and second end of the housing may be connected by one or more outer portions and a plurality of substantially cylindrical inner portions. An actuator may be retained within the housing. The actuator may include an actuation element retained by the first end of the housing, wherein at least a portion of the actuation element is positioned for receiving an actuation load. The actuator may include a plunger comprising at least a first cylindrical portion defined by a first diameter and a second cylindrical portion defined by a second diameter. The plunger may be substantially in contact with the actuation element and may be operable to translate in a first direction when an actuation load is applied to the actuation element. The actuator may include a sealing element placed around the second cylindrical portion of the plunger and substantially in contact with one or more of the inner surfaces of the housing, such that the sealing element provides a seal between the first end and the second end of the housing. The actuator may include a spring operable to apply a force to resist translation of the plunger in the first direction. A switching mechanism may include an electrical switching apparatus retained by the second end of the housing, where the electrical switching apparatus is actuated by translation of the plunger.

This SUMMARY is provided to briefly identify some aspects of the present disclosure that are further described below in the DESCRIPTION. This SUMMARY is not intended to identify key or essential features of the present disclosure nor is it intended to limit the scope of any claims.

The term "aspects" is to be read as "at least one aspect". The aspects described above and other aspects of the present disclosure described herein are illustrated by way of example (s) and not limited by any of the accompanying figures.

BRIEF DESCRIPTION OF THE DRAWINGS

A more complete understanding of the present disclosure may be realized by reference to the accompanying figures in which.

The illustrative aspects are described more fully by the Figures and detailed description. The present disclosure may, however, be embodied in various forms and is not limited to specific aspects described in the Figures and detailed description.

DESCRIPTION

Reference will now be made in detail to exemplary aspects of the present disclosure, including the best modes contemplated by the inventors for carrying out aspects of the disclosure. Examples of these exemplary aspects are illustrated in the accompanying drawings. While the disclosure is described in conjunction with these aspects, it will be understood that it is not intended to limit the invention to the described aspects. Rather, the disclosure is also intended to cover alternatives, modifications, and equivalents as may be included within the spirit and scope of the disclosure as defined by the appended claims. In the following description, specific details are set forth in order to provide a thorough understanding of the present disclosure. Aspects of the present disclosure may be practiced without some or all of these specific details. In other instances, well-known aspects have not been described in detail in order not to unnecessarily obscure the present disclosure.

In this specification and the appended claims, the singular forms "a," "an," and "the" include plural references unless the context clearly dictates otherwise. Unless defined otherwise, all technical and scientific terms used herein have the same meaning as commonly understood to one of ordinary skill in the art to which this disclosure belongs.

Unless otherwise explicitly specified herein, the drawings are not drawn to scale.

Figure 1:
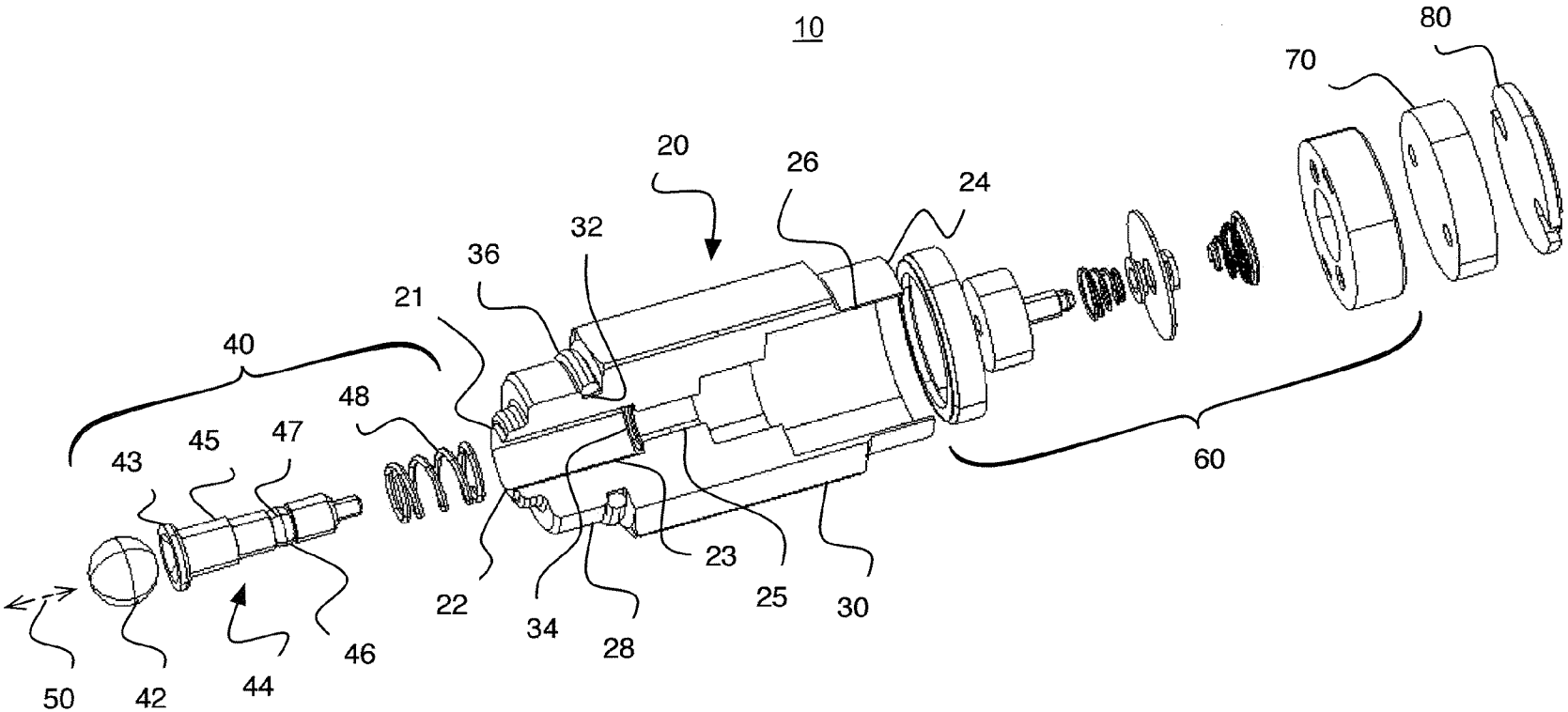
FIG. 1 depicts an exploded view of a switching mechanism according to aspects of the present disclosure.

In FIG. 1, there is shown an exploded view of a switching mechanism 10 according to aspects of the present disclosure. A switching mechanism may include a housing 20 (for example, a metal housing, mounting bushing, and/or body) encasing an actuator 40 at a first end 22 and an electrical switching apparatus 60 (for example, including electrical contacts) at a second end 24.

A housing 20 may be made from metal or any other type of material. A housing 20 may be fabricated from, for example, steel (for example, alloy steel, stainless steel, corrosion resistant steel (CRES), or any other type of steel), aluminum, or any other suitable material. The housing 20 may be hollow and may include a first end 22 and a second end 24. A first end 22 and a second end 24 may be connected and/or joined by one or more outer portions and one or more substantially cylindrical inner surfaces and/or portions 23, 25, 26. A first end 22 may include, for example, a retention element 21 (for example, a lip element or other feature). Substantially cylindrical inner portions 23, 25, 26 may encase, enclose, house, and/or be in contact with components of an actuator 40, electrical switching apparatus 60, and potentially other components. One or more substantially cylindrical inner portions 23, 25, 26 may include, for example, one or more cylindrical or substantially cylindrical surfaces each defined by a diameter. Diameters of each of the cylindrical inner portions 23, 25, 26 may be related to a size of components encased within housing 20 and/or other factors. For example, a first substantially cylindrical inner portion 23 at a first end of housing 22 may be defined by a first diameter. The first substantially cylindrical portion 23 may be connected to a second substantially cylindrical inner portion 25 defined by a smaller diameter. A third substantially cylindrical inner portion 26 may be connected to the second substantially cylindrical inner portion 25, and the third substantially cylindrical inner portion 26 may be defined by a diameter larger than the diameter of the second substantially cylindrical inner portion 25. Diameters of each cylindrical inner portion of housing may be progressively smaller (for example, telescope down) and/or may be progressively larger (for example, telescope up or out) between the first end of housing 22 and second end of housing 24.

One or more outer portions may include one or more threaded portions 28, one or more hexagonal portions 30, one or more substantially cylindrical outer portions 32, and possibly other features. One or more threaded portions 28 may be used to connect a switching apparatus 10 to an application specific mounting hole. Threaded portion(s) 28 may be used, for example, to install switching mechanism 10 into various environments (for example, systems) including, for example, vehicle systems (for example, diesel engine systems, vehicle transmissions, vehicle doors), consumer appliances (for example, dishwasher doors), hydraulics, industrial machinery, aerospace systems, and/or many other type of systems. Switching mechanism 10 may, for example, be installed into a system (for example, an engine air intake system) by mounting, screwing, or affixing the threaded portion(s) 28 into a mounting hole associated with the system (for example, an engine air intake system). Threaded portion 28 may, for example, be threaded into a hole (for example, a mounting hole) associated with a system such that a first end 22 of housing 20 is substantially flush and/or aligned with a surface of the system (for example, an engine air intake system).

One or more hexagonal portions 30 may be utilized to facilitate installation of switching mechanism 10 into a mounting hole. For example, hexagonal portions 30 may be sized to fit commonly used wrench size(s) (for example, a 0.875 hexagonal socket wrench or any other type of wrench). A switching mechanism 10 may be screwed, threaded, or otherwise installed to a system using, for example, a wrench (for example, a socket wrench), fingers, or any other device.

Substantially cylindrical outer portions 32 may each be defined by a diameter (for example, an outer diameter). A size of the cylindrical outer portions 32 (for example, a diameter of the cylindrical outer portions) may be defined by spatial requirements associated with installation of a switching mechanism 10, structural considerations (for example, structural strength), environmental considerations (for example, temperature, pressure, and/or other environmental factors), aesthetic considerations, and/or other factors.

In some aspects, a switching mechanism 10 may include an outer sealing element 36 placed around a substantially cylindrical outer portion 32 of housing 20. A substantially cylindrical outer portion 32 may be between a threaded portion 28 and a hexagonal portion 30 of housing 20. Outer sealing element 36 may be a tubular shaped elastic material. Outer sealing element 36 may be, for example, an O-ring, rubber seal, grommet, and/or any other type of seal. Outer sealing element 36 may be made from rubber, natural polymers, synthetic polymers, Buna-N Rubber, or any other material.

According to some aspects, a switching mechanism 10 may be installed into a system (for example, an engine system) by threading and/or screwing threaded portion 28 into a hole (for example, a threaded mounting hole) in the system. Outer sealing element 36 may generate or create a seal preventing fluid from passing through the hole. Switching mechanism 10 installed in a hole in system may seal the hole, thereby maintaining pressure within the system, reducing fluid flow into and/or out of the system, and ensuring proper operation of the system.

An actuator 40 installed in housing 20 may be ball-type, plunger, push-button, and/or other type of slideably moveable actuator. An actuator 40 (for example, a ball-type actuator) may include, for example, an actuation element 42 (for example, an actuator ball), plunger 44 (for example, plunger body), sealing element 46, actuator spring 48, and possibly other components. An actuator 40 may, in some aspects (for example, as discussed below in connection with FIG. 2), include a plunger spring, a plunger ball, and possibly other components. An actuation element 42, plunger 44, sealing element 46, actuator spring 48, and possibly other components may be assembled along a first direction 50 (for example, a first axis). A first direction 50 may be a direction between a first end 22 and a second end 24 of housing 20. A first direction 50 may, for example, be a major axis of housing 20 and/or switching mechanism 10.

An actuation element 42 may be, for example, a ball, push-button, or any other device operable to receive an actuation load. An actuation element 42 (for example, a ball, actuator ball, a ball element, ball bearing) may be a metal ball, a steel ball (for example, stainless steel, alloy steel, or other type of steel ball), a ball bearing, or any other type of rolling ball. A ball may, in some aspects, be polished, buffed, and/or treated to increase a smoothness of ball thereby reducing friction during use. An actuation element 42 may, in some aspects, be treated for hardness (for example, using any suitable metal hardening process). An actuation element 42 (for example, a ball) may be encased, enclosed, and retained by a first end of housing 20. A ball 42 may be encased by a retention feature 21 in first end of housing 20 such that a portion of the ball 42 may protrude from housing 20 (for example, from first end 22 of housing 10) in some operational states of switching mechanism 10. At least a portion of the actuation element 42 may be positioned to receive an actuation load (for example, from an component of another system), and the actuation element 42 may be in contact with, supported by, and/or rest upon plunger 44.

A plunger 44 may be substantially cylindrical and may be fabricated from metal (for example, stainless steel, alloy steel, or any other type of material) or any other suitable type of material. A plunger 44 may, for example, resemble or loosely resemble a golf tee. Plunger 44 may include a first end 43 (for example, an actuator ball support end), at least two substantially cylindrical portions, a second end (for example, a distal end), and/or possibly other features. A first end 43 (for example, ball support portion) may, for example, include a depression, cup, and/or dimpled feature shaped to at least substantially match the shape and/or contour of ball 42. A first end 43 may be connected to a second end of plunger (for example, a distal end) by one or more substantially cylindrical portions. Substantially cylindrical portions of plunger 44 may, for example, be defined by different diameters.

In some aspects, one or more small diameter portions may be defined by relatively small or first diameter(s) (for example, 0.189 inches (3/16") or any other diameter) and one or more large diameter portions may be defined by a relatively large or second diameter(s) (for example, 0.312 inches (5/16") or any other diameter). A ratio of a first diameter to a second diameter may be, for example, three to five (for example, 3:5). One or more large diameter sections may, in some aspects, be defined by diameter(s) larger than 0.312 inches (5/16"). Similarly, one or more small diameter sections may be defined by diameter(s) less than 0.189 inches.

In some aspects, a diameter of the first end of plunger 43 may be greater than a diameter of the second end and/or the one or more substantially cylindrical portions. For example, the first end 43 may be defined by a first end diameter, a first substantially cylindrical portion 45 may be connected to first end and may be defined by a diameter less than the first end diameter. A second substantially cylindrical portion 47 may be connected to first substantially cylindrical portion 45 and second substantially cylindrical portion 47 may be defined by a diameter smaller than first substantially cylindrical portion. Substantially cylindrical portions of plunger 44 may telescope down in diameter and/or telescope up in diameter between first and second end of plunger.

In some aspects, upon installation of actuator 40 into housing, a first end of plunger 43, a first substantially cylindrical portion of plunger 45, and possibly other elements of plunger may be encased within a first substantially cylindrical inner portion 23 of housing. A second substantially cylindrical portion 47 of plunger may be encased within a second substantially cylindrical portion 25 of housing. Because diameters associated with first end 43, first substantially cylindrical portion 45, second substantially cylindrical portion 47, and other portions of plunger may be less than an inner diameter of first end 22 and/or first substantially cylindrical portion 23 of housing, actuator 40 may be installed from a first end of housing 22 while other components (for example, electrical switching apparatus 60, second end sealing element 70, cap 80, and/or other components) may be independently installed from a second end of housing 24.

A sealing element 46 may be placed around, wrapped around, and/or affixed to a cylindrical portion of plunger 44. A sealing element 46 may be a tubular shaped elastic material (for example, an O-ring). Sealing element 46 may be, for example, an O-ring, rubber seal, grommet, and/or any other type of seal. Sealing element 46 may be made from rubber, natural polymers, synthetic polymers, Buna-N Rubber, or any other material. Sealing element 46 may, for example, be placed around a cylindrical portion of plunger 44. A sealing element 46 may, for example, have an inner diameter smaller and/or less than a diameter of a cylindrical portion of plunger 44. Sealing element 46 may be stretched during assembly to wrap around cylindrical portion of plunger 44, and may be tightly wrapped around and/or in substantial contact with the plunger 44 after assembly. Sealing element 46 may, for example, be placed and/or wrapped around a cylindrical portion of plunger 44 defined by a relatively small diameter (for example, a second cylindrical portion 47).

In some aspects, sealing element 46 may contact and/or substantially be in contact with plunger 44 and housing 20 during operation of switching mechanism 10. Sealing element 46 may, for example, be in contact with a cylindrical portion of plunger 44 (for example, second cylindrical portion 47) and one or more inner surfaces of housing 20 (for example, second substantially cylindrical inner portions 25) creating a seal between a first end of housing 22 and a second end of housing 24. Sealing element 46 may be in contact with a reduced diameter portion of housing 20 (for example, second substantially cylindrical portion 25 of housing) to reduce an area of contact between sealing element 46 and housing 20 while generating a seal. A seal between a first end of housing 22 and a second end of housing 24 may reduce and/or resist an amount of fluid flow (for example, air flow) between the first end 22 and second end 24 of housing. A seal between the first end 22 and second end 24 may resist, reduce, and/or eliminate plunger 44 translation, sliding, and/or movement as a result of pressure loads (for example, due to variations in pressure of, for example, 60 pounds per square inch (psi)) and may, as a result, reduce or eliminate undesirable, unintended, and/or self actuation of electrical switching apparatus 60. A seal between the first end 22 and second end 24 may reduce and/or eliminate pressure loads applied to electrical switching apparatus 60 and other components of switching mechanism 10.

A spring 48 (for example, actuator spring) may apply and/or generate a force to resist translation of plunger 44 (for example, in first direction 50). The spring 48 may, for example, contact housing 20 (for example, an internal surface portion 34 of housing 20) and plunger 44. Spring 48 may, for example, resist translation and/or movement of plunger (for example, in a first direction 50) by applying a spring force to plunger 44 and housing 20. A spring force may be applied to plunger 44 and ball 42 and may force a portion of ball 42 to protrude from first end of housing 20 in a free position, quiescent state, and/or first state of actuator 20. A free position, quiescent state, and/or first state of actuator 20 may be a position or state of actuator when no load is applied to actuator 20 (for example, applied to ball 42). A depressed, actuated, loaded, and/or second state of actuator 20 may be a position and/or state when a load is applied to actuator 20 (for example, applied to ball 42). Spring 48 may generate a spring load resisting depression, actuation, and/or load applied to ball 42. A spring load (for example, generated by spring 48) may restore actuator to a free position, quiescent state, and/or first state after a load has been removed by applying a spring force to plunger 44. The spring force applied to plunger 44 may cause plunger 44 to push actuation element 42 toward first end of housing 20 thereby maintaining actuation element 42 in a first state, free state, and/or quiescent state.

Upon actuation (for example, when a load is applied to actuation element 42), plunger 44 may translate in a first direction 50 (for example, in a direction from first end of housing 22 to second end 24). Plunger 44 may travel in a first direction 50 and may actuate an electrical switching apparatus 60 (for example, an electrical switch). Electrical switching apparatus 60 may be, for example, a plate type electrical switch, a micro switch, and/or any other suitable type of electrical switching apparatus. An electrical switching apparatus 60 shown in FIG. 1 may be, for example, a plate type switching apparatus. Aspects of the present disclosure incorporating a micro switch are discussed infra in connection with FIG. 2.

Plunger 44 may, for example, actuate the electrical switching apparatus 60 by contacting a portion of electrical switching apparatus 60. Plunger 44 contact with a portion of electrical switching apparatus 60 may, for example, change a state of electrical switching apparatus 60 generating a signal. For example, plunger 44 translation may depress a plate including electrical contacts causing the electrical contacts associated with the plate to meet, contact and/or separate from other electrical contacts thereby completing, closing, opening, and/or breaking a circuit and generating a signal. A signal may be output to other systems and/or components associated with switching mechanism 10. Systems and/or components associated with switching mechanism 10 may be, for example, an engine system (for example, a diesel air intake system), a vehicle transmission, and/or any other type of system.

In some aspects, switching mechanism 10 may include a second end sealing element 70 (for example, second sealing element). Second sealing element 70 may be a compression seal made from an elastomer (for example, silicon rubber), rubber, natural polymer, synthetic polymer, and/or other materials. Second sealing element 70 may resemble a cylinder, puck, and/or disc. Second end sealing element 70 may include holes, cutouts, and/or pass thru(s) to accommodate wires and/or wire leads associated with electrical switching apparatus 60. A switching mechanism 10 may be sealed at second end of the housing 24 by affixing the second end sealing element 70. The second end sealing element 70 may, for example, include an outer diameter larger (for example, slightly larger) than an inner diameter of housing 20. For example, a second end sealing element 70 may be press fit into the second end of the housing 20. The second sealing element 70 may, for example, be affixed to housing 20 (for example, one or more inner portions 26 of housing, second end of housing 24, or other portion(s) of housing) using, for example, an adhesive, glue, sealant, epoxy, and/or other materials. Adhesive, glue, sealant, epoxy, and/or materials may be applied around electrical connectors passing through second sealing element 70 to insulate electrical switching apparatus 60 and other switching mechanism 10 components from environmental factors. Sealing switching mechanism 10 at a second end 24 may reduce damage to the electrical switching apparatus 60 components resulting from, for example, moisture, particulate matter, slurry, and/or other environmental factors.

In some aspects, a cover 80 may be affixed to a second of housing 24. A cover may, for example, be fabricated from steel (for example, alloy steel, stainless steel, corrosion resistant steel (CRES), or any other type of steel), metal, plastic, or any other suitable material. A cover 80 may enclose a second end of housing 24. Cover 80 may for example, be affixed to housing 20, second sealing element 70, and possibly other components using adhesive, glue, sealant, epoxy, fasteners (for example, screws, rivets, an/or other fasteners), and/or other materials. Cover 80 and/or second sealing element 70 may, in some aspects, be swaged into housing 20.

Figure 2:
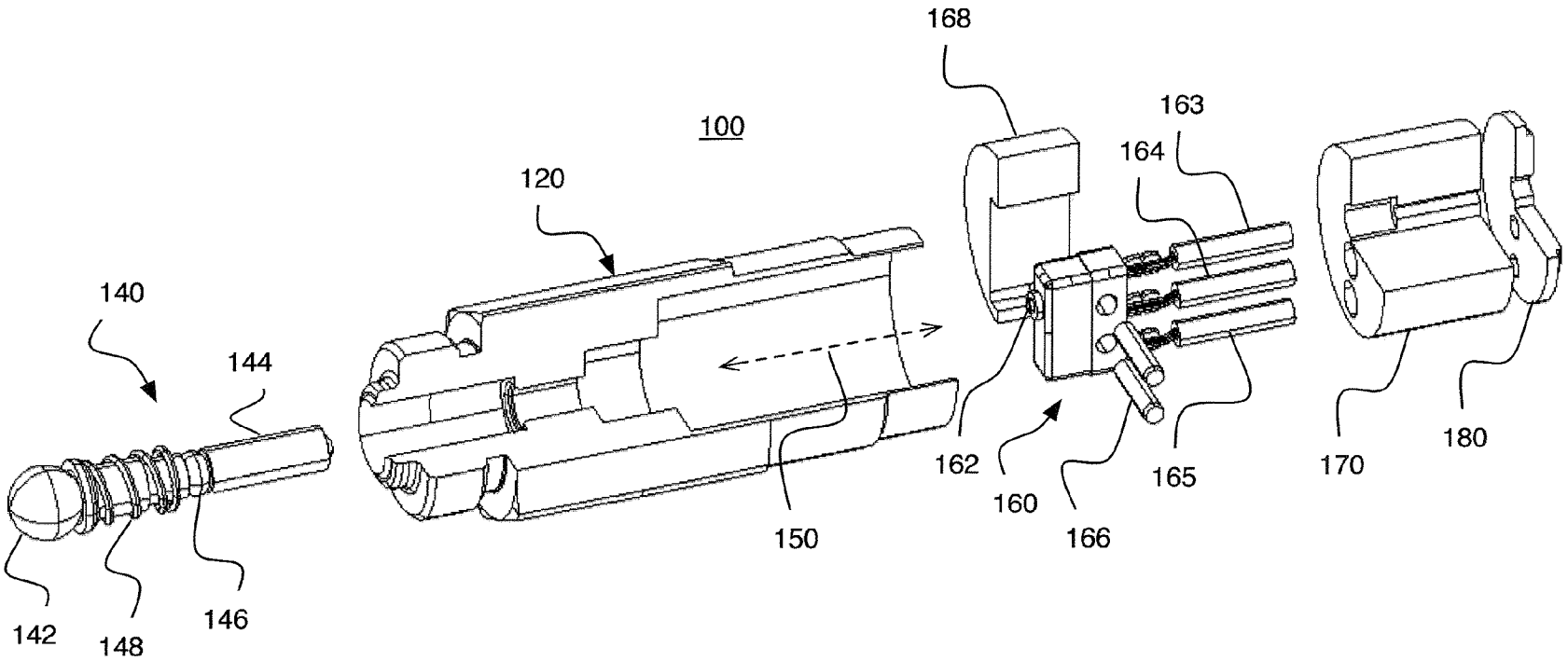
FIG. 2 depicts an exploded view of another switching mechanism according to aspects of the present disclosure.

In FIG. 2, there is shown an exploded view of a switching mechanism 100 according to aspects of the present disclosure. Switching mechanism 100 may include a housing 120, actuator 140, electrical switching apparatus 160 (for example, a micro switch), and other components. Housing 120 may be similar to housing 20 as discussed supra in connection with FIG. 1.

Electrical switching apparatus 160 may, for example, be a micro switch, miniature snap action switch, or any other type of electrical switching apparatus. Electrical switching apparatus 160 may include, for example, a boss, a button 162 protruding from the boss, wire leads 163, 164, 165 (for example, electrical connectors), and possibly other components. Electrical switching apparatus 160 may be actuated when the button 162 is depressed. A button 162 may be depressed by, for example, actuator 140. Actuator 140 may, for example, receive an actuation load (for example, from a component of a system associated with switching mechanism 100) and a plunger 144 associated with actuator 140 may translate in a first direction 150 towards electrical switching apparatus 160. Actuator 140 may, for example, include a plunger ball (for example, a second ball as discussed below in connection with FIG. 3) encased within a plunger body 144. The plunger ball or other component(s) of actuator 140 may come into contact with, apply a force to, and/or depress a button 162 associated with electrical switching apparatus 160. Depressing the button 162 associated with electrical switching apparatus 160 may, for example, actuate electrical switching apparatus 160 (for example, a micro switch) by changing a state of electrical switching apparatus 160. A state of electrical switching apparatus 160 may be changed by, for example, connecting electrical contacts associated with wire leads within electrical switching apparatus 160. For example, a first wire lead 163 may be a common lead, a second lead 164 may be normally open, and a third wire lead 165 may be normally closed. A first wire lead 163 and third wire lead 165 may be connected in a quiescent and/or non-actuated state. Depressing button 162 may, for example, change a state of electrical switching apparatus 160 by disconnecting first wire lead 163 from third wire lead 165 and connecting first wire lead 163 to second wire lead 164 thereby changing signals in wire leads 163, 164, 165. A change in state of electrical switching apparatus 160 may, for example, indicate that a load is applied to actuator 140 (for example, applied to first ball or actuation element 142).

In some aspects, electrical switching apparatus 160 may be installed into housing 120 using mounting pins 166, retainer 168, and possibly other components. Mounting pins 166 and retainer 168 (for example, electrical switching apparatus retainer) may, for example, support or mount electrical switching apparatus within housing 120.

According to some aspects, switching mechanism 100 may include a second sealing element 170. Second sealing element 170 may include holes, cutouts, and/or pass thru(s) to accommodate wire leads 163, 164, 165 associated with electrical switching apparatus 160. A second sealing element 170 may, for example, be affixed to housing 120 (for example, one or more inner portions of housing, a second end of housing 24 as discussed in FIG. 1, or other portion(s) of housing) by press fitting second sealing element 170 into housing 120 and/or using, for example, an adhesive, glue, sealant, epoxy, and/or other materials. Adhesive, glue, sealant, epoxy, and/or materials may be applied around wire leads 163, 164, 165 passing through second sealing element 170 to insulate electrical switching apparatus 160, wire leads 163, 164, 165 and other switching mechanism 100 components from environmental factors.

In some aspects, a cover 180 may be affixed to a second end of housing 120. Cover 180 may for example be affixed to housing 120, second sealing element 170, and possibly other components using adhesive, glue, sealant, epoxy, fasteners, and/or materials.

Figure 3:
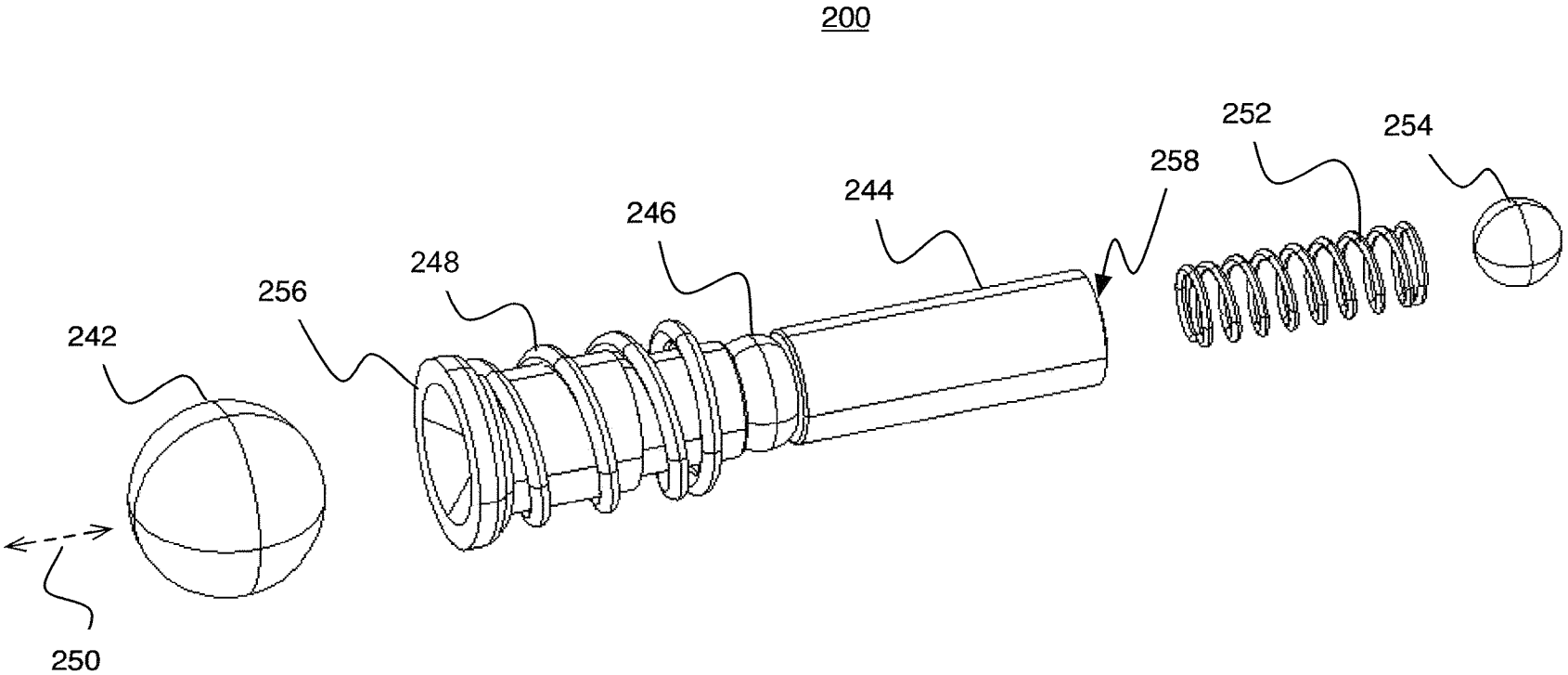
FIG. 3 is an exploded view of an actuator according to aspects of the present disclosure.

FIG. 3 depicts an actuator 200 according to aspects of the present disclosure. An actuator 200 may include an actuation element 242 (for example, a first ball and/or actuator ball), plunger body 244 (for example, a plunger), sealing element 246, a first spring 248 (for example, an actuator spring), a second spring 252 (for example, a plunger spring), a plunger ball 254 (for example, a second ball), and/or other components. The actuation element 242, plunger 244, sealing element 246, first spring 248, and possibly other components may be similar and/or equivalent to actuator components discussed supra in connection with FIG. 1 (for example, components of actuator 40 in FIG. 1). The plunger body 244 may, for example, be similar to a plunger 44 as discussed in connection with FIG. 1.

A plunger spring 252 and a plunger ball 254 (for example, second ball) may, for example, be made from steel (for example, alloy steel, stainless steel, corrosion resistant steel (CRES), or any other type of steel), metal, or any other suitable material. A plunger spring 252 may be, for example, a compression spring. A spring rate of a plunger spring 252 may be related to a force required to actuate electrical switching apparatus. A ratio of spring rate of plunger spring 252 to an actuation force required to actuate electrical switching apparatus may be, for example, three to one (for example, 3:1) or any other ratio. A plunger ball 254 may be, for example, a ball bearing defined by a diameter of 0.281 inches (9/32") or any other diameter.

In some aspects, a plunger spring 252 (for example, second spring), a plunger ball 254 (for example, second ball), and possibly other components may be partially or fully encased, housed and/or enclosed within plunger body 244. A plunger spring 252 and plunger ball 254 may, for example, be partially or fully encased by a second end 258 of plunger (for example, a distal end of plunger). Second end 258 of plunger may, for example, include a retention feature, lip element, or other feature, which restrains, encases, and/or houses plunger ball 254 (for example, the retention feature may be discussed in further detail below in connection with FIG. 5). Plunger spring 252 may, for example, be preloaded during assembly to apply a constant spring pressure to plunger ball 254 in a direction outward from second end 258 of plunger (for example, in a direction towards electrical switching apparatus). Plunger ball 254 may be restrained or encased by a retention feature (for example, a lip element) or other feature in second end 258 of plunger and may, for example, protrude beyond or extend from second end 258 of plunger in an unloaded, quiescent, and/or free state of actuator 200.

In some aspects, plunger 244 may translate in a first direction 250 and second ball 254 may contact electrical switching apparatus 260. As second ball 254 comes into contact with electrical switching apparatus 260, plunger spring 252 may be depressed and/or contracted. Plunger spring 252 may absorb a portion of the load transferred to electrical switching apparatus 260 and may compensate for actuator or plunger 244 over-travel. By absorbing at least a portion of the actuation load, an amount of load applied to electrical switching apparatus 260 may be reduced.

Figure 4:
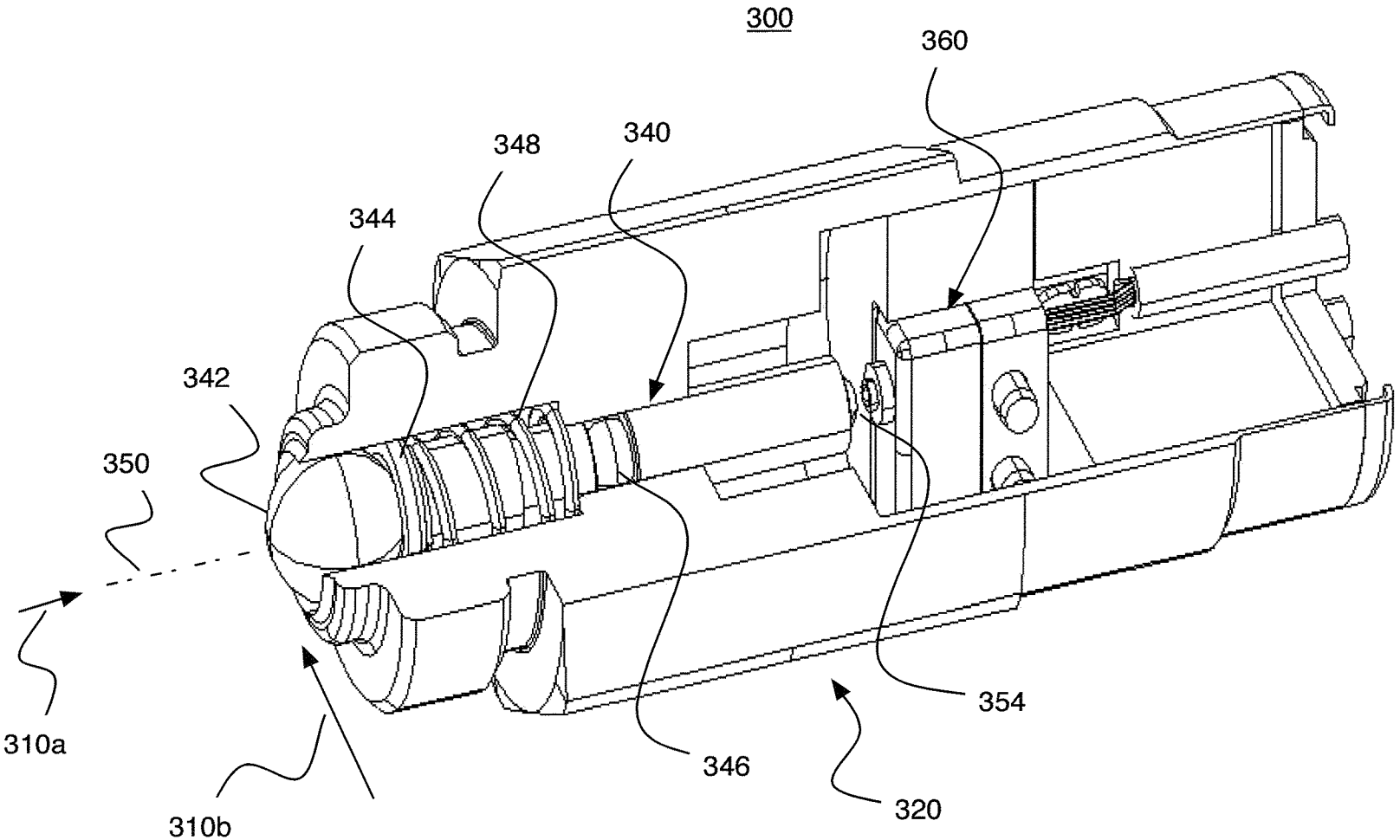
FIG. 4 depicts a switching mechanism according to aspects of the present disclosure.

FIG. 4 depicts a switching mechanism 300 according to aspects of the present disclosure. Actuator 340 may be operable to receive an actuation load 310. An actuation load 310*a* may, for example, be applied to an actuation element 342 (for example, actuator ball) along a first direction and/or axis 350 or an actuation load 310*b* may be applied at an angle from the first direction 350. An actuation load 310*b* may, for example, applied at angle of zero degrees, 45 degrees, 90 degrees, or any other angle relative to first direction 350 at which the actuation load may be applied to the first ball 342. The actuation element 342 (for example, an actuator ball) may be substantially in contact with a plunger 344 (for example, a plunger body), and an actuation load 310 may be transferred and/or transmitted from the first ball 342 to the plunger 344. An actuation load 310 transferred to plunger 344 may be resisted and/or opposed by a spring force generated by a first spring 348, friction between a sealing element 346 and housing 320, and possibly other forces. The first spring 348 may generate a spring force in a direction opposite to translation of plunger 344 (for example, opposite to a direction 350) and may restore actuator 340 to an un-loaded or quiescent state after a load 310 has been removed.

A friction force (for example, friction) between a sealing element 346 and housing 320 may be generated as a result of interfering contact between sealing element 346 and housing 320. Friction between sealing element 346 and housing 320 may impede translation of actuator 340 thereby affecting smoothness of switching mechanism operation. For example, increased friction may increase an actuation force 310 required to actuate electrical switching apparatus thereby impeding or influencing the function of systems operating in conjunction with switching mechanism 300 (for example, air intake valves or other systems). A friction force may be related to a size of sealing element 346 (for example, contact area). Friction force may, for example, increase as a square of an increase in contact area between sealing element 346 and housing 320. Sealing element 346 in combination with a first cylindrical portion of plunger 344 around which sealing element 346 is wrapped may, in some aspects, be as small as possible to reduce a contact area between the sealing element 346 and the housing 320. A reduction in contact area may reduce a friction force applied to actuator 340. To reduce contact area, sealing element 346 may be in substantial contact with and/or create a seal in conjunction with a cylindrical inner portion of the housing 320 having a reduced diameter relative to other cylindrical inner portions of housing 320. The sealing element 346 may, in some aspects, be in substantial contact with and/or create a seal in conjunction with a cylindrical inner portion of the housing 320 having a smallest diameter relative to other cylindrical inner portions of the housing 320. To reduce a size of sealing element 346 a cross-section area and/or diameter of plunger 344 may be reduced in a portion of plunger that sealing element is installed around (for example, to 0.189 inches or any other diameter) to facilitate installation of smaller sealing element 346. Sealing element 346 may, in some aspects, be a 0.19 inch (3/16") diameter O-ring or any other size O-ring.

According to some aspects, as a result of an actuation load 310 (for example, actuation load 310*a* or actuation load 310*b*) a plunger 344 may translate, slide, and/or move in a first direction and/or axis 350. If actuation load 310 is above a threshold load, plunger 344 may translate in a first direction 350 and may contact electrical switching apparatus 360. In some aspects, plunger 344 contact with electrical switching apparatus 360 (for example, a plate type electrical switch as shown in FIG. 1) may actuate electrical switching apparatus 360.

In some aspects, an electrical switching apparatus 360 may be a micro switch (as shown in FIG. 4). In some aspects, a plunger 344 used with a micro switch may include a plunger ball 354 (for example, a second ball) and plunger spring (not shown) to reduce an amount of actuation load 310 applied to the micro switch. Plunger ball 354 may, for example, contact electrical switching apparatus 360 and as plunger ball 354 contacts the electrical switching apparatus 360, a plunger spring (not shown) may be depressed and/or contracted. A plunger spring may absorb a portion of the load transferred to electrical switching apparatus 360 and may compensate for actuator 340 over-travel. For example, a total travel of an actuator 340 may be, for example, 0.125 inches or any other distance, and a distance of travel required for actuation of an electrical switching apparatus 360 may be 0.025 inches or any other distance. Upon receiving an actuation load 310, plunger 344 may travel 0.025 inches and plunger ball 354 may come into contact with electrical switching apparatus 360 and may actuate electrical switching apparatus 360. After contacting electrical switching apparatus 360, plunger 344 may continue to travel towards electrical switching apparatus 360, and plunger ball 354 may remain in contact with electrical switching apparatus 360 while second spring absorbs at least a portion of the actuation load 310. By absorbing at least a portion of the actuation load, an amount of load applied to electrical switching apparatus 360 may be reduced, and a distance of permissible plunger 348 and/or actuator 340 travel may be increased. For example, the plunger body 348 may continue to translate towards the electrical switching apparatus 360 after the plunger ball 354 has contacted electrical switching apparatus 360 and/or depressed a button associated with electrical switching apparatus 360. Plunger ball 354 may remain substantially stationary and in contact with button associated with electrical switching apparatus 360 while plunger body continues to translate.

Figure 5:
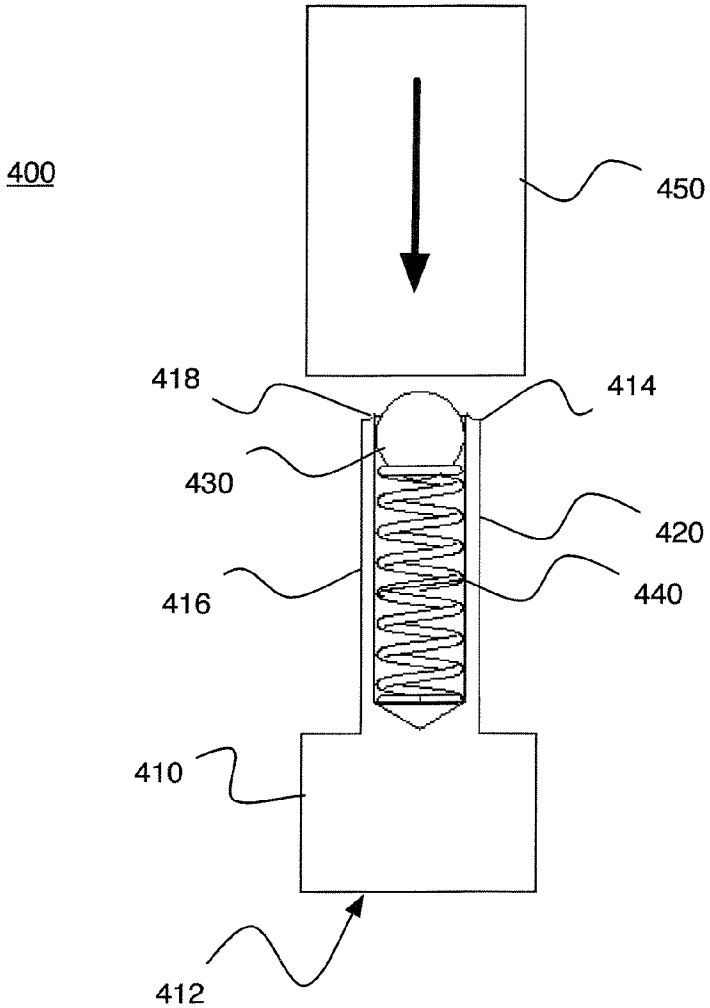
FIG. 5 is a diagram illustrating a method of manufacturing a plunger according to aspects of the present disclosure.

FIG. 5 is a diagram illustrating a method of manufacturing a plunger 400 according to aspects of the present disclosure. The plunger may include, for example, a plunger body 410, a plunger spring 440, a plunger ball 430, and possible other components. In some aspects, a plunger 400 may not include a plunger spring 440, plunger ball 430, and/or other components and may include only a plunger body 410. A plunger body 410 may include a first end 412, a second end 414, one or more substantially cylindrical portions 416, and possibly other features. At least one of the substantially cylindrical portions 416 may be a hollow cylindrical portion 420. The second end 414 may include a protrusion 418 (for example, a break edge, boss and/or raised feature). The plunger shown in FIG. 5 may be a simplified plunger and features may be removed from FIG. 5 for clarity of description.

In some aspects, a plunger spring 440, plunger ball 430, and possibly other components may be inserted into plunger body 410 (for example, hollow cylindrical portion 420). With plunger spring 440, plunger ball 430, and possibly other components inserted in plunger body 410, a first surface 414 may be press-formed, cold-formed, swaged, or otherwise flattened by applying a load to first surface 414. First surface 414 may be press-formed flat using, for example, a punch 450, a press, a hammer, or other device. Press-forming or deforming a first surface may deform a protrusion 418 generating a retention feature. The retention feature may, for example decrease a diameter of a second end of plunger body 414 and may restrain or encase plunger ball 430 (for example, within plunger body 410). Plunger ball 430 may, for example, be encased in plunger body 410 and may be substantially in contact with retention feature when actuator is in a quiescent and or unloaded state.

Figure 6:
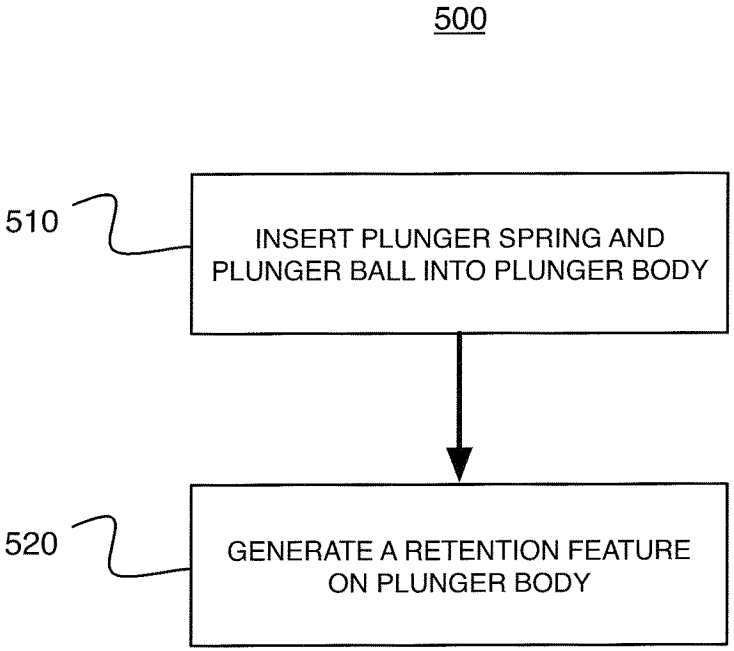
FIG. 6 is a flow diagram of a method of manufacturing a plunger according to aspects of the present invention.

FIG. 6 is a flow diagram 500 of a method of manufacturing a plunger according to aspects of the present invention. In operation 510, a plunger spring (for example, plunger spring 440 of FIG. 5 and/or plunger spring 252 of FIG. 3), a plunger ball (for example, plunger ball 430 of FIG. 5 and/or plunger ball 254 of FIG. 3), and possibly other components may be inserted into plunger body (for example, plunger body 410 of FIG. 5). Plunger body may include a first end and second end. Plunger spring and plunger ball may, for example, be inserted into second end of plunger body. The first and second ends of plunger body may be connected by one or more substantially cylindrical portions and at least one of the substantially cylindrical portions may be a hollow cylindrical portion (for example, hollow cylindrical portion 420 of FIG. 5). A second end of plunger body (for example, second end 414 of FIG. 5) may include a protrusion (for example, protrusion 418 of FIG. 5).

In operation 520, a protrusion on a second end of a plunger body may be deformed to generate a retention feature, and the retention feature may encase, house, or encapsulate the plunger ball (for example, within plunger body). A retention feature may, for example, be generated by press-forming or flattening the second surface and the protrusion. A protrusion and second surface may be press-formed flat using, for example, a punch or other device. At least a portion of plunger ball may, for example, contact retention feature when plunger spring and plunger ball are in a quiescent and/or unloaded state.

Figure 7:
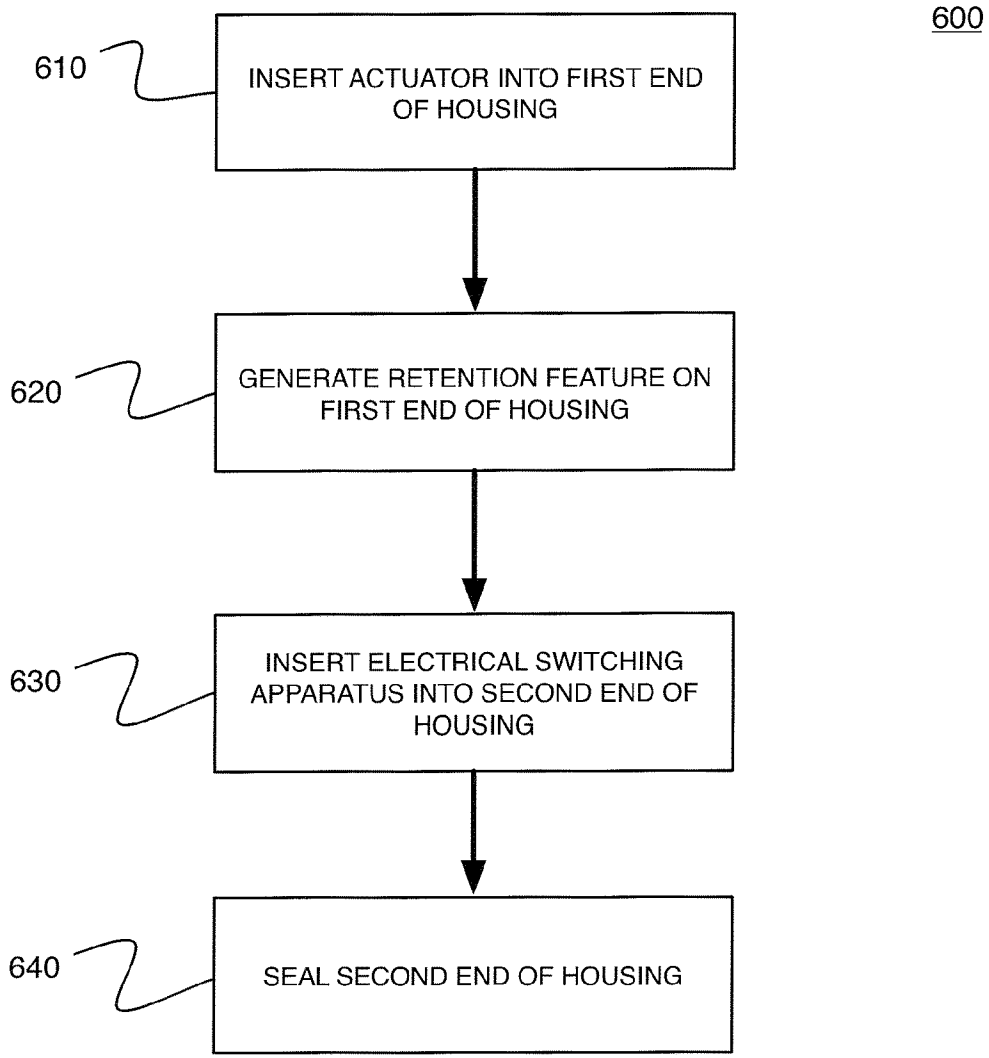
FIG. 7 is a flow diagram of a method of manufacturing a switching mechanism according to aspects of the present invention.

FIG. 7 is a flow diagram 600 of a method of manufacturing a switching mechanism according to aspects of the present invention. In operation 610, an actuator (for example, actuator 40 of FIG. 1 and/or actuator 200 of FIG. 3) may be inserted into first end of a housing (for example, housing 20 of FIG. 1). An actuator may include, for example, an actuation element (for example, actuation element and/or ball 42 of FIG. 1), plunger (for example, plunger 44 of FIG. 1), plunger seal (for example, sealing element 46 of FIG. 1), a spring (for example, actuator spring 46 of FIG. 1). A housing may include a first end and a second end connected by one or more outer portions and one or more substantially cylindrical inner portions. A first end of housing may, for example, include a protrusion, boss, and/or raised surface. The protrusion in first end of housing may be similar to protrusion 418 as discussed in connection with the plunger in FIG. 5.

In operation 620, a retention feature may be generated on a first end of housing to encase an actuator. A retention feature may be similar to retention feature 21 as discussed in connection with FIG. 1. A retention feature may be generated by deforming a protrusion, boss, and/or raised surface on a first end of the housing. A protrusion may be, for example, deformed using a press-forming, swaging, cold-forming, or any other operation. In a press-forming operation, a load may, for example, be applied to a first end of housing to flatten the first surface of the housing. As the first end of the housing is flattened, the protrusion may be deformed to create a retention feature extending towards a center of housing. A retention feature may reduce a diameter of housing at the first end of the housing. The retention feature may encase, house, and/or encapsulate an actuator resisting translation of an actuation element (for example, actuation element and/or ball 42 of FIG. 1). At least a portion of actuation element (for example, ball 42 of FIG. 1) may be, for example, in contact with retention feature when actuator is in a quiescent state (for example, when zero or minimal actuation load is applied to actuator).

In some aspects, generating a retention feature on a first end of the housing encasing the actuator may allow the actuator to be inserted into housing from the first end while electrical switching apparatus components are inserted independently from second or opposite end of housing. Generating a retention feature may allow for installation of a plunger including one or more substantially cylindrical inner portions defined by diameters smaller than the largest outer diameter of the plunger (for example, the diameter of the first end of the plunger). For example, a plunger may include from a first end of the plunger one or more progressively smaller substantially cylindrical portions, and a housing may include from a first end one or more progressively smaller substantially cylindrical inner portions. Inserting the plunger into the first end of housing may enable a portion of plunger defined by a smallest diameter relative to other portions of plunger to be retained with a substantially cylindrical portion of housing defined by a smallest diameter relative to other portions of housing. A sealing element may, for example, be wrapped around a portion of plunger defined by a smallest diameter, and the sealing element may be in contact with the smallest diameter substantially cylindrical portion of the housing.

In operation 630, an electrical switching apparatus (for example, electrical switching apparatus 60 of FIG. 1) may be inserted into a second end of housing.

In operation 640, a second end of the housing may be sealed. In some aspects, a second end sealing element (for example, second end sealing element 70 of FIG. 1) may affixed to second end of the housing. A second end sealing element may, for example, be press fit into second end of housing. For example, an outer diameter of the second end sealing element may be greater than an inner diameter of housing, and the sealing element may be press fit into the housing creating a seal between electrical switching apparatus and second end of housing. In some aspects, a cover (for example, cover 80 of FIG. 1) may be affixed to the second end of the housing and/or the second end sealing element using, for example, a sealant, epoxy, glue, and/or fasteners (for example, screws, rivets, or other fasteners).

At this point, while we have discussed and described the disclosure using some specific examples, those skilled in the art will recognize that our teachings are not so limited. Accordingly, the disclosure should be only limited by the scope of the claims attached hereto.

The invention claimed is:

1. A switching mechanism, comprising:

a housing including a first end and a second end;

an actuator comprising an actuation element retained at the first end of the housing, wherein at least a portion of the actuation element is positioned externally from the housing for receiving an actuation load;

a plunger substantially in contact with at least a portion of the actuation element positioned internally from the housing and operable to translate in a first direction when the actuation load is applied to the externally-positioned portion of the actuation element, the plunger comprising:

a plunger body including first and second cylindrical portions, the second cylindrical portion having a hollow cylindrical portion, a sealing element placed around the second cylindrical portion of the plunger and substantially in contact with one or more inner surfaces of the housing, to provide a seal between the first end and the second end of the housing, an actuation spring in contact with the plunger body operable to apply a force to resist translation of the plunger in the first direction by the actuation load, a plunger spring encased in the hollow cylindrical portion of plunger body, and a plunger ball retained by the plunger spring and a second end of the plunger body, and an electrical switching apparatus retained at the second end of the housing, and configured to be actuated by the translation of the plunger, wherein the plunger ball contacts the electrical switching apparatus with the translation of the plunger, and the plunger spring compresses in response to the plunger ball contacting the electrical switching apparatus such that the load applied to the electrical switching apparatus by the plunger ball is reduced from the actuation load.

2. The switching element of claim 1, wherein the actuation element comprises a second ball.

3. The switching mechanism of claim 1, wherein the diameter of the first cylindrical portion of the plunger body diameter is greater than the diameter of the second cylindrical portion of the plunger body.

4. The switching mechanism of claim 3, wherein a ratio of the first diameter to the second diameter is five to three.

5. The switching mechanism of claim 1, wherein one or more of the housing, or the plunger are fabricated from alloy steel.

6. The switching mechanism of claim 1, wherein the sealing element comprises an O-ring.

7. The switching mechanism of claim 1, further comprising:

a second end sealing element affixed to the second end of the housing, where an outer diameter of the sealing element is greater than an inner diameter at the second end of the housing and the sealing element is press fit into the housing; and a cover affixed to the second end of the housing and the second end sealing element.

8. The switching mechanism of claim 1, wherein outer portion of the housing comprise:

one or more threaded portions;

one or more hexagonal portions; and one or more substantially cylindrical outer portions.

9. The switching mechanism of claim 8, further comprising an outer sealing element placed around one of the one or more substantially cylindrical outer portions of the housing, the one substantially cylindrical outer portion being positioned between one of the one or more threaded portions and one of the one or more hexagonal portions of the housing.

10. The switching mechanism of claim 1, wherein:

the second cylindrical portion of the plunger body includes a retention element; and the plunger ball is retained within the hollow cylindrical portions by the second spring and the retention element.

11. The switching mechanism of claim 1, wherein the electrical switching apparatus comprises a micro switch.

12. The switching mechanism of claim 1, wherein the electrical switching apparatus comprises a plate type electrical switch.

13. The switching mechanism of claim 1, wherein the housing includes a retention feature at the first end, where the retention feature retains the actuation element within the housing when the switching mechanism is in an unloaded state.

14. A method of manufacturing a switching mechanism, comprising the steps of:

providing a plunger comprising:

a plunger body including first and second cylindrical portions, the second cylindrical portion having a hollow cylindrical portion.

a sealing element placed around the second cylindrical portion of the plunger, an actuation spring, positioned over the first cylindrical portion and retained by a first end of the plunger body, a plunger spring encased in a hollow cylindrical portion of the second cylindrical portion of plunger the body, and a plunger ball retained by the plunger spring and a second end of the plunger body; providing a housing with first and second ends, the housing including a protrusion extending outwardly from the first end inserting the plunger into the housing at the first end, whereby the second cylindrical portion of the plunger body extends from a first cylindrical cavity of the housing adjacent the first end into a second cylindrical cavity of the housing, the second cylindrical cavity having a diameter that is less than a diameter of the first cylindrical portion of the plunger body, inserting an actuation element of an actuator into the housing, at the first end in contact with the first end of the plunger body;

deforming the protrusion on the first end of the housing after inserting:the actuation element into the housing to generate a retention feature, where the retention feature encases the actuation element of the actuator within the housing;

inserting an electrical switching apparatus into the housing at the second end; and sealing the second of the housing.

15. The manufacturing method of claim 14, wherein the deforming step comprises press forming the first end of the housing to generate the retention feature.

16. The manufacturing method of claim 14, wherein the sealing step comprises:

inserting a second sealing element into the housing at the second end to generate a seal between the electrical switching apparatus and the housing.

17. The manufacturing method of claim 16, wherein the sealing step further comprises:

affixing a cap at the second of the housing, where wire leads associated with the electrical switch apparatus pass through holes in the second sealing element and the cap.

18. The manufacturing method of claim 14, wherein the plunger ball is retained by performing the steps of:

providing a second protrusion extending outwardly from the second cylindrical portion of the plunger body;

inserting the plunger spring and the plunger ball into the hollow cylindrical protion of the plunger body; and deforming the second protrusion on the second end of the plunger body to generate a second retention feature, where the second retention feature encases the plunger ball.

19. The manufacturing method of claim 18, wherein the deforming step includes press forming the retention feature.

* * * * *